US011462202B2

(12) United States Patent
Tachi et al.

(10) Patent No.: US 11,462,202 B2
(45) **Date of Patent: *Oct. 4, 2022**

(54) ACTIVE NOISE CONTROL SYSTEM BASED ON HEAD POSITION

(71) Applicants: ALPS ALPINE CO., LTD., Tokyo (JP); A School Corporation Kansai University, Suita (JP)

(72) Inventors: Ryosuke Tachi, Iwaki (JP); Yoshinobu Kajikawa, Suita (JP)

(73) Assignees: ALPS ALPINE. CO . LTD, Tokyo (JP); A SCHOOL CORPORATION KANSAI UNIVERSITY, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/362,287

(22) Filed: Jun. 29, 2021

(65) Prior Publication Data

US 2022/0005450 A1 Jan. 6, 2022

(30) Foreign Application Priority Data

Jul. 3, 2020 (JP) ..... JP2020-115461

(51) Int. Cl.
*G10K 11/178* (2006.01)

(52) U.S. Cl.
CPC .. *G10K 11/17817* (2018.01); *G10K 11/17875* (2018.01); *G10K 2210/1282* (2013.01); *G10K 2210/3221* (2013.01)

(58) Field of Classification Search
CPC ..... G10K 11/17817; G10K 11/17875; G10K 2210/1282; G10K 2210/3221
USPC ..... 381/71.1
See application file for complete search history.

(56) References Cited

U.S. PATENT DOCUMENTS 11,335,314 B2 * 5/2022 Tachi ..... G10K 11/17854
2006/0285697 A1 12/2006 Nishikawa et al.
2010/0124337 A1 * 5/2010 Wertz ..... G10K 11/17854 381/71.11

(Continued)

FOREIGN PATENT DOCUMENTS

JP 2018-072770 5/2018

OTHER PUBLICATIONS

European Search Report dated Nov. 19, 2021 in corresponding European Application No. 21181408.2, 9 pages.

*Primary Examiner* — Paul Kim
*Assistant Examiner* — Douglas J Suthers
(74) *Attorney, Agent, or Firm* — Crowell & Moring LLP

(57) ABSTRACT

In a first system signal processing unit, an adaptive filter generates a noise cancel sound, a first system selector selects an output of a first system auxiliary filter corresponding to a noise cancel position matching a detected position of a right ear of a user from a plurality of first system auxiliary filters corresponding to different noise cancel positions, and a first system subtractor subtracts the selected output from an output of a first microphone and outputs the subtracted result as an error signal to a first system adaptive filter and a second system adaptive filter of a second system signal processing unit. The noise cancel positions are arranged at predetermined intervals in a space where the user can move the right ear due to turning and side bending of the head within a predetermined range in the up-down and front-back directions.

12 Claims, 7 Drawing Sheets

(56) References Cited

U.S. PATENT DOCUMENTS

| | | | | |
|---|---|---|---|---|
| 2011/0142247 | A1* | 6/2011 | Fellers | G10K 11/17827 381/71.1 |
| 2018/0192226 | A1* | 7/2018 | Woelfl | H04R 5/033 |
| 2019/0035380 | A1* | 1/2019 | Zafeiropoulos | G10K 11/17817 |
| 2020/0211526 | A1 | 7/2020 | Tachi et al. | |

* cited by examiner

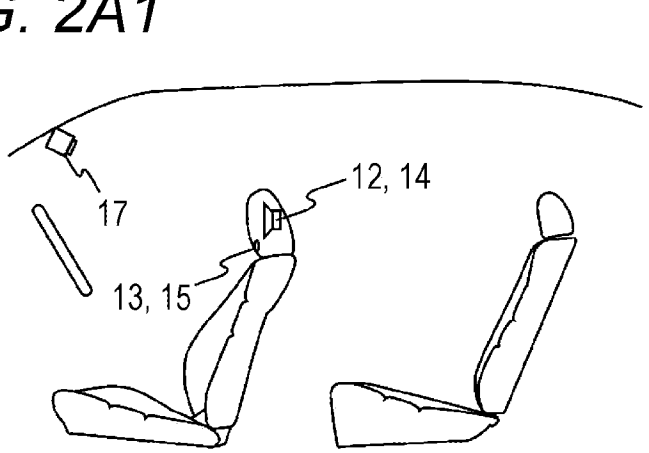
FIG. 2A1
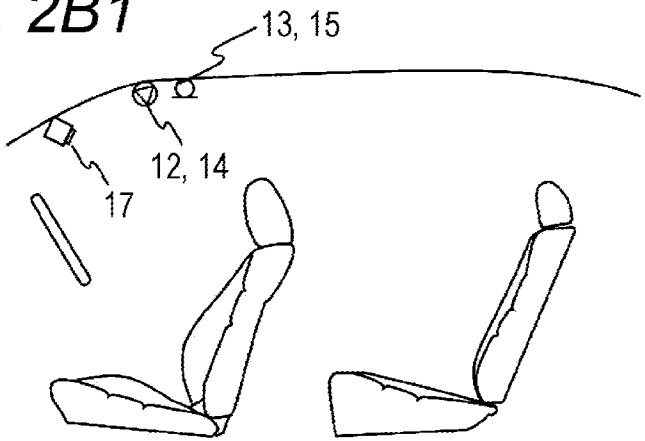
FIG. 2B1
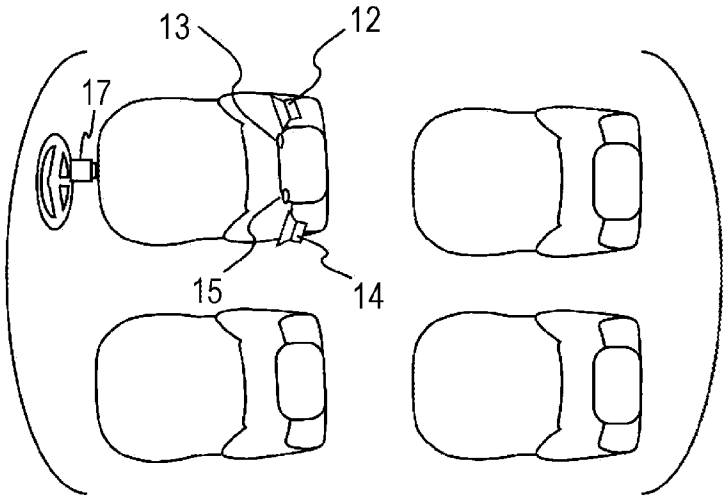
FIG. 2A2
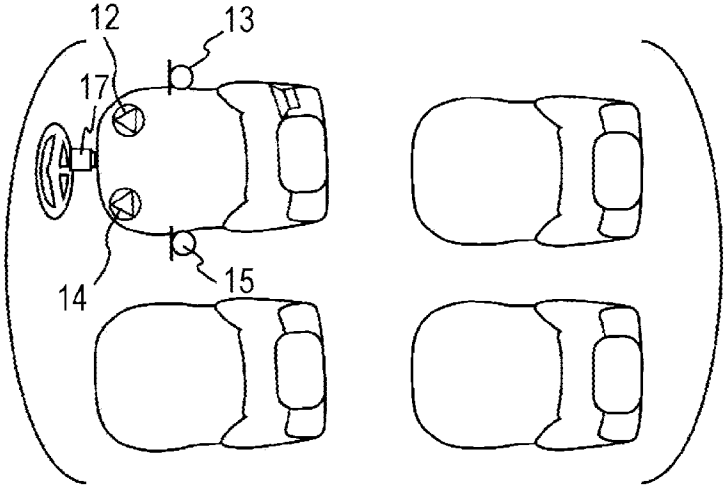
FIG. 2B2

ACTIVE NOISE CONTROL SYSTEM BASED ON HEAD POSITION

RELATED APPLICATION

The present application claims priority to Japanese Patent Application Number 2020-115461, filed Jul. 3, 2020, the entirety of which is hereby incorporated by reference.

BACKGROUND

1. Field of the Invention

The present invention relates to active noise control (ANC) technology that reduces noise by emitting noise cancel sounds to cancel out noise.

2. Description of the Related Art

As an active noise control technique for reducing noise by radiating a noise cancel sound to cancel noise, a technique is known in which a microphone and a speaker arranged near a noise cancel position and an adaptive filter, which generates a noise cancel sound output from the speaker by applying a transfer function adaptively set to an output signal of a noise source or a signal simulating the output signal, are provided and the transfer function is adaptively set as an error signal obtained by correcting the output of the microphone using an auxiliary filter in the adaptive filter (for example, JP 2018-72770 A).

In this technology, a transfer function learned in advance which corrects a difference between a transfer function from a noise source to a noise cancel position and a transfer function from the noise source to the microphone and a difference between a transfer function from the speaker to the noise cancel position and a transfer function from the speaker to the microphone is preset in the auxiliary filter, and the auxiliary filter is used to cancel noise at a noise cancel position different from a position of the microphone.

In the case of canceling noise heard by a user by using the technology for canceling the noise at a noise cancel position different from the position of the microphone using the above-mentioned auxiliary filter, if a head of a user shifts from the noise cancel position along with the displacement of the user, the noise heard by the user may not be canceled satisfactorily.

Therefore, it is conceivable to cancel the noise audible to the user regardless of the displacement of a user's head by providing a plurality of auxiliary filters learned about a plurality of different noise cancel positions and switching the auxiliary filter to be used to the auxiliary filter learned about the transfer function for the corresponding noise cancel position at the position of the head with the displacement of the user's head.

However, in a case where the noise can be satisfactorily canceled in the entire three-dimensional region around the standard position of the user's head, it is necessary to set a large number of noise cancel positions, and the number of auxiliary filters becomes excessive.

SUMMARY

Therefore, an object of the present disclosure is to provide an active noise control system capable of canceling noise regardless of displacement of a user's head with a relatively simple configuration.

In order to achieve the above object, the present disclosure provides an active noise control system for reducing noise, the active noise control system including: a head detection unit configured to detect positions of a head of a user seated on a seat; a switching control unit; a speaker configured to output a noise cancel sound; a microphone configured to detect an error signal; a plurality of auxiliary filters, which correspond to a plurality of mutually different noise cancel positions, configured to generate and output, from a noise signal representing noise, a correction signal for correcting an error signal detected by the microphone so as to compensate for a difference between a position of the microphone and a noise cancel position corresponding to the auxiliary filter; an error correction unit configured to correct an error signal output from the microphone with a correction signal output from one of the auxiliary filters and output the corrected signal as a corrected error signal; and an adaptive filter configured to perform an adaptation operation using a corrected error signal output from the error correction unit to generate a noise cancel sound output from the speaker from the noise signal. Here, the switching control unit causes the error correction unit to correct the error signal using a correction signal output from an auxiliary filter at which a corresponding noise cancel position matches a position of the head detected by the head detection unit. In addition, a plurality of noise cancel positions corresponding to the plurality of auxiliary filters are a plurality of positions arranged at a predetermined interval only in a space in which a user can move the head due to turning and side bending of the head, when the user sits on a seat, the head standing upright and facing front being at a position of a center of the seat in a left-right direction and at an arbitrary position within a predetermined range in up-down and front-back directions.

In order to achieve the above object, according to the present disclosure, another active noise control system that reduces noise includes a head detection unit configured to detect positions of left and right ears of a user seated on a seat, a switching control unit, and two noise control systems of a right ear noise control system and a left ear noise control system. Each of the noise control systems includes: a speaker configured to output a noise cancel sound; a microphone configured to detect an error signal; a plurality of auxiliary filters, which correspond to a plurality of mutually different noise cancel positions, configured to generate and output, from a noise signal representing noise, a correction signal for correcting an error signal detected by the microphone so as to compensate for a difference between a position of the microphone and a noise cancel position corresponding to the auxiliary filter; an error correction unit configured to correct an error signal output from the microphone with a correction signal output from one of the auxiliary filters and output the corrected signal as a corrected error signal; and an adaptive filter configured to perform an adaptation operation using a corrected error signal output from the error correction unit of the right ear noise control system and a corrected error signal output from the error correction unit of the left ear noise control system to generate a noise cancel sound output from the speaker from the noise signal. In addition, the switching control unit causes the error correction unit of the right ear noise control system to correct the error signal using a correction signal output from an auxiliary filter at which a corresponding noise cancel position matches a position of the right ear detected by the head detection unit, and causes the error correction unit of the left ear noise control system to correct the error signal using a correction signal output from an auxiliary filter at which a corresponding noise cancel position matches a position of the left ear detected by the head detection unit. A plurality of noise cancel positions corresponding to the plurality of auxiliary filters of the right ear noise control system are a plurality of positions arranged at a predetermined interval only in a right ear target space that is a space in which a user can move a right ear due to turning and side bending of the head, when the user sits on a seat, the head standing upright and facing front being at a position of a center of the seat in a left-right direction and at an arbitrary position within a predetermined range in up-down and front-back directions. A plurality of noise cancel positions corresponding to the plurality of auxiliary filters of the left ear noise control system are a plurality of positions arranged at a predetermined interval only in a left ear target space that is a space in which a user can move the left ear due to turning and side bending of the head when the user sits on a seat, the head standing upright and facing front being at a position of a center of the seat in a left-right direction and at an arbitrary position within a predetermined range in up-down and front-back directions.

Furthermore, in such an active noise control system, the right ear target space may be a three-dimensional space obtained as a trajectory obtained by moving a plane obtained as a trajectory obtained by rotating a line, the line being obtained by rotating a point at a position of a right ear of a head at any position within the predetermined range in up-down and front-back directions at a position of a seat center in a left-right direction, around a turning axis of the head at the position within a predetermined angular range within a laterally bendable angle range around a side bending axis of the head at the position within a predetermined angular range within a side bendable angular range within a range in which the right ear moves in the up-down and front-back directions with movement of the head standing upright and facing front within the predetermined range. The left ear target space may be a three-dimensional space obtained as a trajectory obtained by moving a plane obtained as a trajectory obtained by rotating a line, the line being obtained by rotating a point at a position of a left ear of a head at any position within the predetermined range in up-down and front-back directions at a position of a seat center in a left-right direction, around a turning axis of the head at the position within a predetermined angular range within a laterally bendable angle range around a side bending axis of the head at the position within a predetermined angular range within a side bendable angular range within a range in which the left ear moves in the up-down and front-back directions with movement of the head standing upright and facing front within the predetermined range.

According to the active noise control system as described above, the noise cancel position where the auxiliary filter is provided can be limited to a position within a range where the user's head and ears can be located. Therefore, the noise can be canceled regardless of the displacement of the user's head by providing a relatively small number of auxiliary filters.

Here, in the active noise control system as described above, the predetermined interval is desirably an interval of a distance of 1/10 of a wavelength of an upper limit frequency of noise to be canceled by the active noise control system.

In this way, the noise cancel position and the number of auxiliary filters can be minimized within a range in which the noise can be satisfactorily canceled regardless of the displacement of the user's head.

In such an active noise control system, the seat may be a seat of an automobile.

As described above, according to the present disclosure, it is possible to provide an active noise control system capable of canceling noise regardless of displacement of a user's head with a relatively simple configuration.

BRIEF DESCRIPTION OF THE DRAWINGS

FIGS. 2A1, 2A2, 2B1, and 2B2 are diagrams illustrating an arrangement of speakers and microphones in the active noise control system according to the embodiment of the invention;

DETAILED DESCRIPTION OF THE PREFERRED EMBODIMENTS

In the following, an embodiment of the invention will be described.

Figure 1:
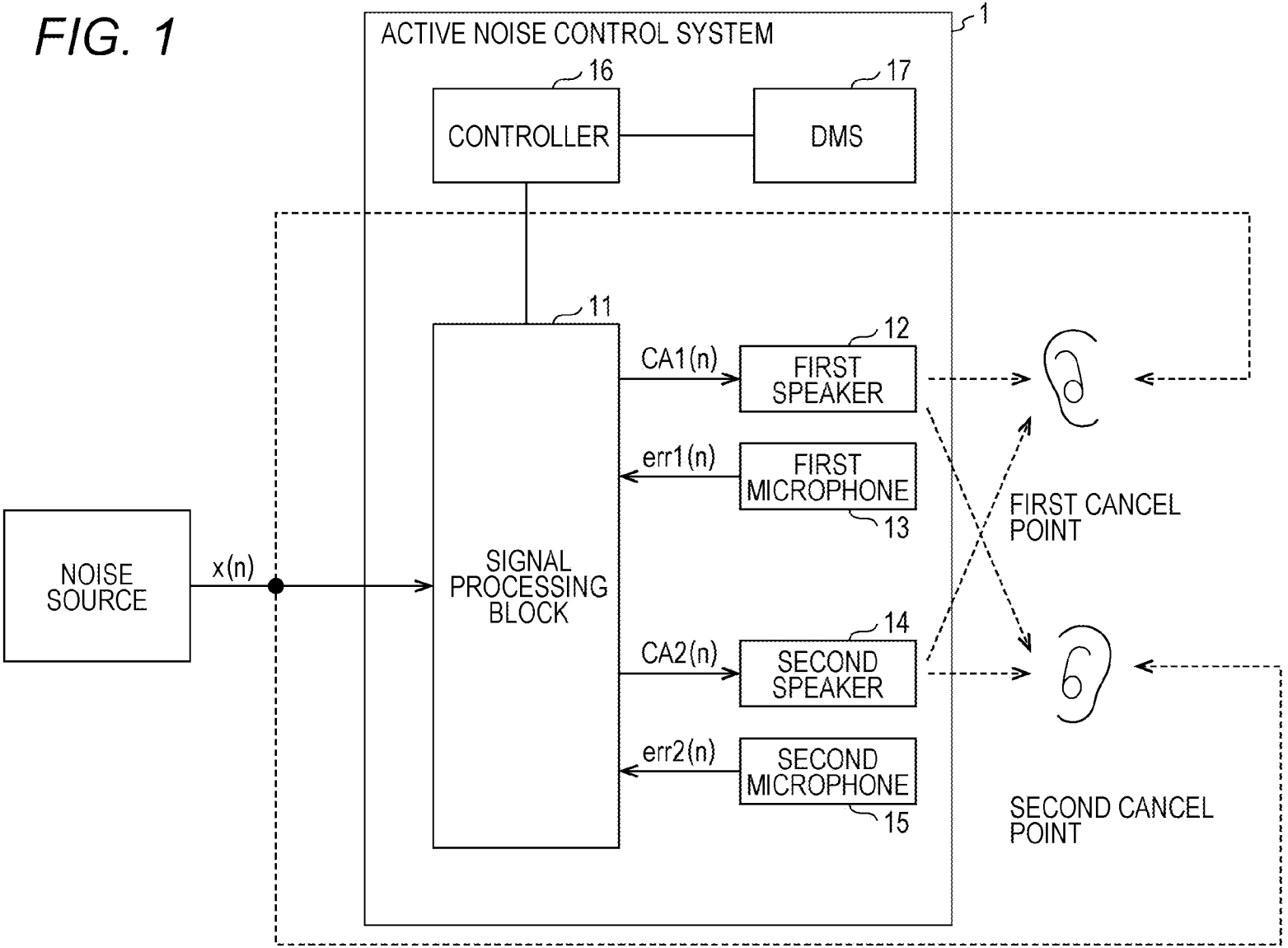
FIG. 1 is a block diagram illustrating a configuration of an active noise control system according to an embodiment of the invention.

FIG. 1 illustrates a configuration of the active noise control system according to the embodiment.

As shown in the drawing, an active noise control system 1 includes a signal processing block 11, a first speaker 12, a first microphone 13, a second speaker 14, a second microphone 15, a controller 16, and a driver monitoring system 17 (DMS 17) that detects a state such as a position and a posture of a user's head by a near infrared camera or the like.

The active noise control system 1 according to the present embodiment is a system mounted in an automobile, and is a system that cancels noise generated by a noise source at each of two cancel points with a standard right ear position of a user seated on a noise cancel target seat that is a seat of the automobile to be subjected to noise cancel as a first cancel point and a standard left ear position of the user as a second cancel point.

As illustrated in FIGS. 2A1 and 2A2, the first speaker 12 and the first microphone 13 are disposed in a headrest of a noise cancel target seat (driver's seat in the drawing) at a position near a standard position of the right ear of the user seated on the seat, and second speaker 14 and the second microphone 15 are disposed in a headrest of a seat of a user to be subjected to noise cancel at a position near a standard position of the left ear of the user seated on the seat.

Alternatively, as illustrated in FIGS. 2B1 and 2B2, the first speaker 12 may be disposed at a position above and in front of the standard position of the right ear of the user seated on the noise cancel target seat on the ceiling of the passenger compartment of the automobile, the second speaker 14 may be disposed at a position above and in front of the standard position of the left ear of the user seated on the noise cancel target seat on the ceiling of the passenger compartment, the first microphone 13 may be disposed at a position on the right side of the first speaker 12 and closer to the noise cancel target seat than the first speaker 12 on the ceiling in front of the user, and the second microphone 15 may be disposed at a position on the left side of the second speaker 14 and closer to the noise cancel target seat than the second speaker 14 on the ceiling in front of the user. When the first speaker 12 and the second speaker 14 are disposed on the ceiling as described above, superdirective parametric speakers may be used as the first speaker 12 and the second speaker 14.

Referring back to FIG. 1, using a noise signal x(m) indicating the noise generated by the noise source, a first microphone error signal errl($n$) that is a voice signal picked up by the first microphone 13, and a second microphone error signal err2($n$) that is a voice signal picked up by the second microphone 15, the signal processing block 11 respectively generates a first cancel signal CA1($n$) and outputs the first cancel signal CA1($n$) from the first speaker 12, and generates a second cancel signal CA2($n$) and outputs the second cancel signal CA2($n$) from the second speaker 14.

Then, the noise generated by the noise source are cancelled at the first cancel point and the second cancel point by the first cancel signal CA1($n$) output from the first speaker 12 and the second cancel signal CA2($n$) output from the second speaker 14.

Figure 3:
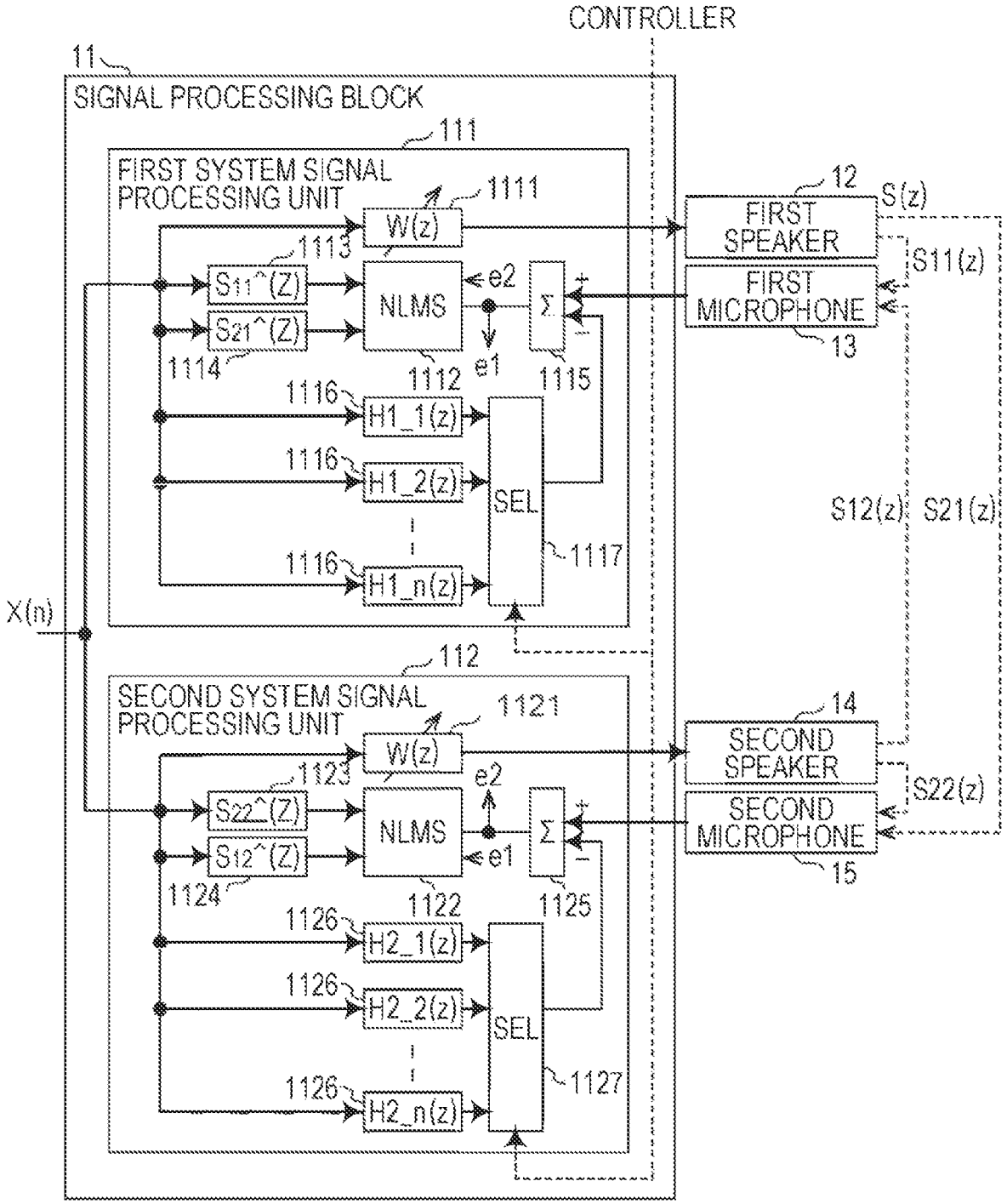
FIG. 3 is a block diagram illustrating the configuration of a signal processing block according to the embodiment of the invention.

Next, as illustrated in FIG. 3, the signal processing block 11 includes a first system signal processing unit 111 that mainly performs processing relevant to the generation of the first cancel signal CA1($n$) and a second system signal processing unit 112 that mainly performs processing relevant to the generation of the second cancel signal CA2($n$).

The first system signal processing unit 111 includes a first system variable filter 1111, a first system adaptive algorithm execution unit 1112, a first system first-stage estimation filter 1113 in which a transfer function S11ˆ($z$) is set in advance, a first system second-stage estimation filter 1114 in which a transfer function S21ˆ($z$) is set in advance, a first system subtractor 1115, n first system auxiliary filters 1116 in which a transfer function H1_i($z$) is set in advance, and a first system selector 1117 that selects and outputs any one of the outputs of the n first system auxiliary filters 1116. Here, i is an integer from 1 to n, and the transfer function H1_i($z$) is a transfer function of the i-th first system auxiliary filter 1116.

In such a configuration of the first system signal processing unit 111, the input noise signal x(n) is output to the first speaker 12 as the first cancel signal CA1($n$) through the first system variable filter 1111.

The input noise signal x($n$) is transmitted to the first system selector 1117 through each first system auxiliary filter 1116, and the first system selector 1117 selects the output of any one of the first system auxiliary filters 1116 and outputs the selected output to the first system subtractor 1115. The first system subtractor 1115 subtracts the output of the first system selector 1117 from the first microphone error signal err1($n$) picked up by the first microphone 13, and outputs the output as an error e1 to the first system adaptive algorithm execution unit 1112 and the second system signal processing unit 112.

The first system variable filter 1111, the first system adaptive algorithm execution unit 1112, the first system first-stage estimation filter 1113, and the first system second-stage estimation filter 1114 form a multiple error filtered-X adaptive filter. In the first system first-stage estimation filter 1113, an estimated transfer characteristic S11ˆ($z$) of a transfer function S11($z$) from the first system signal processing unit 111 to the first microphone 13 calculated by actual measurement or the like is set in advance. The first system first-stage estimation filter 1113 convolves the input noise signal x($n$) with the transfer characteristic S11ˆ($z$), and inputs the resultant signal to the first system adaptive algorithm execution unit 1112. In addition, in the first system second-stage estimation filter 1114, an estimated transfer characteristic S21ˆ($z$) of a transfer characteristic S21($z$) indicating a transfer function from the first system signal processing unit 111 to the second microphone 15 calculated by actual measurement or the like is set in advance. The first system second-stage estimation filter 1114 convolves the input noise signal x($n$) with a transfer characteristic S21ˆ($z$), and inputs the resultant signal to the first system adaptive algorithm execution unit 1112.

Thus, the first system adaptive algorithm execution unit 1112 receives the noise signal x(n) in which the transfer function S11ˆ($z$) is convoluted by the first system first-stage estimation filter 1113, the noise signal x(n) in which the transfer function S21ˆ($z$) is convoluted by the first system second-stage estimation filter 1114, the error e1 output from the first system subtractor 1115, and an error e2 output from the second system signal processing unit 112, executes an adaptive algorithm such as NLMS, updates the coefficient of the first system variable filter 1111 so that the errors e1 and e2 become 0, and adapts a transfer function W1($z$).

The second system signal processing unit 112 has the same configuration as the first system signal processing unit 111, and the second system signal processing unit 112 includes a second system variable filter 1121, a second system adaptive algorithm execution unit 1122, a second system first-stage estimation filter 1123 in which a transfer function S22ˆ($z$) is set in advance, a second system second-stage estimation filter 1124 in which a transfer function S12ˆ($z$) is set in advance, a second system subtractor 1125, n second system auxiliary filters 1126 in which a transfer function H2_i($z$) is set in advance, and a second system selector 1127 that selects and outputs any one of the outputs of the n second system auxiliary filters 1126. Here, i is an integer from 1 to n, and the transfer function H2_i($z$) is a transfer function of the i-th second system auxiliary filter 1126.

In such a configuration of the second system signal processing unit 112, the input noise signal x($n$) is output to the second speaker 14 as the second cancel signal CA2($n$) through the second system variable filter 1121.

The input noise signal x($n$) is transmitted to the second system selector 1127 through each second system auxiliary filter 1126, and the second system selector 1127 selects the output of one of the second system auxiliary filters 1126 and outputs the selected output to the second system subtractor 1125. The second system subtractor 1125 subtracts the output of the second system selector 1127 from the second microphone error signal err2($n$) picked up by the second microphone 15, and outputs the result as an error e2 to the second system adaptive algorithm execution unit 1122 and the first system signal processing unit 111.

The second system variable filter 1121, the second system adaptive algorithm execution unit 1122, the second system first-stage estimation filter 1123, and the second system second-stage estimation filter 1124 form a multiple error filtered-X adaptive filter. In the second system first-stage estimation filter 1123, an estimated transfer characteristic S22ˆ($z$) of a transfer function S22($z$) from the second system signal processing unit 112 to the second microphone 15 calculated by actual measurement or the like is set in advance. The second system first-stage estimation filter 1123 convolves the input noise signal x(n) with the transfer characteristic S22ˆ($z$), and inputs the resultant signal to the second system adaptive algorithm execution unit 1122. In addition, in the second system second-stage estimation filter 1124, an estimated transfer characteristic S12ˆ($z$) of a transfer characteristic S12($z$) indicating a transfer function from the second system signal processing unit 112 to the first microphone 13 calculated by actual measurement or the like is set in advance. The second system second-stage estimation filter 1124 convolves the input noise signal x(n) with the transfer characteristic S12ˆ($z$), and inputs the resultant signal to the second system adaptive algorithm execution unit 1122.

Thus, the second system adaptive algorithm execution unit 1122 receives the noise signal x(n) in which the transfer function S22ˆ($z$) is convoluted by the second system first-stage estimation filter 1123, the noise signal x($n$) in which the transfer function S12ˆ($z$) is convoluted by the second system second-stage estimation filter 1124, the error e2 output from the second system subtractor 1125, and the error e1 output from the first system signal processing unit 111, executes an adaptive algorithm such as NLMS, updates the coefficient of the second system variable filter 1121 so that the error e1 and error e2 become 0, and adapts a transfer function W2($z$).

In advance, n point sets each of which is a pair of one first cancel point and one second cancel point are set for the active noise control system 1, the i-th first system auxiliary filter 1116 of the first system signal processing unit 111 corresponds to the first cancel point of the i-th point set, and the i-th second system auxiliary filter 1126 of the second system signal processing unit 112 corresponds to the second cancel point of the i-th point set.

In addition, a combination of the position and posture of the head of the user is set as the head state, the point sets are set corresponding to mutually different head states, the first cancel point corresponds to the position of the right ear in the head state corresponding to the point set to which the first cancel point belongs, and the second cancel point corresponds to the position of a certain left ear in the head state corresponding to the point set to which the second cancel point belongs.

Figure 4A:
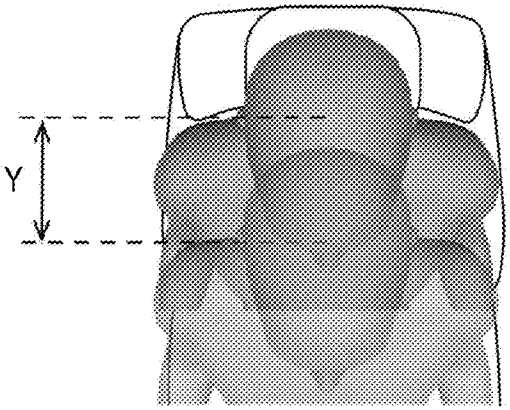
FIGS. 4A to 4D are diagrams illustrating a method of setting a point set according to the embodiment of the invention.
Figure 4B:
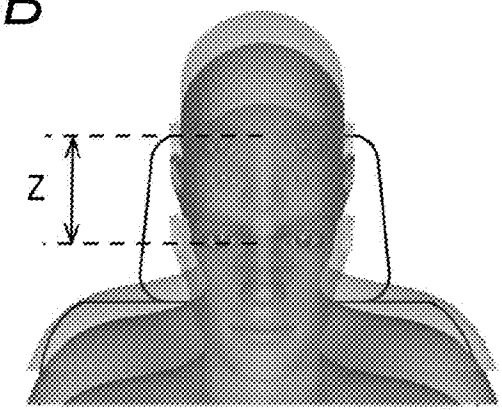

The head state corresponding to the point set is defined as follows. First, a range in the front-back direction in which the head of the user seated on the noise cancel target seat standing upright and facing front can be approximately located is obtained in consideration of a difference in seating position and seating posture for each user, and is set as an existence range Y in the front-back direction of the user's head illustrated in FIG. 4A. In addition, a range in the up-down direction in which the head of the user seated on the noise cancel target seat standing upright and facing front can be approximately located is obtained in consideration of the difference in sitting height and sitting posture for each user, and is set as an existence range Z of the head of the user in the up-down direction illustrated in FIG. 4B. However, as the position of the head in the front-back direction, the position of the ear in the front-back direction is used, and as the position of the head in the up-down direction, the position of the ear in the up-down direction is used.

Figure 4C:
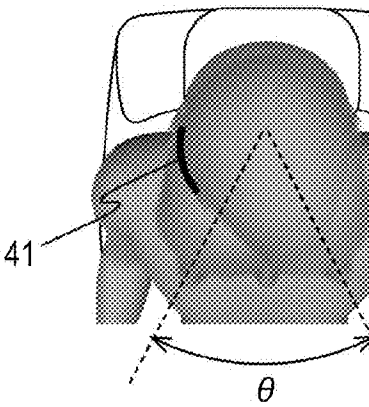

In addition, an angular range in which the head of the user seated on the noise cancel target seat can turn about the axis in the up-down direction is set as an angular range θ around the axis in the up-down direction of the automobile illustrated in FIG. 4C in consideration of the range in which the human body facing forward can naturally turn the head. In addition, an angular range in which the head of the user seated on the noise cancel target seat can be inclined about the axis in the front-back direction is set as an angular range φ of the head around the axis in the front-back direction of the automobile illustrated in FIG. 4D in consideration of the range in which the human body facing forward can naturally side bend the head.

Then, a range of combinations of positions and postures that can be taken by the head is set as a head state range when the head standing upright and facing front at arbitrary position, which is a position of the seat center in the left-right direction and within the existence range Y and the existence range Z in the front-back and up-down directions, is turned at an arbitrary angle within the angular range θ around the turning center axis and bent sideways at an arbitrary angle within the angular range φ around the lateral flexion center axis, and the head state in which the point set is set such that the interval between the first cancel points and the interval between the second cancel points of each point set become a predetermined distance L is selected as many as possible from the head state range.

Here, the predetermined distance L, which is the interval between the first cancel points and the interval between the second cancel points, is set to 1/10 of the wavelength of the upper limit frequency of the noise to be canceled since ZoQ (zone of Quiet), which is a spatial range in which the noise can be satisfactorily canceled, is a spherical space centered on the first cancel point/the second cancel point having a diameter of 1/10 of the wavelength of the frequency for each frequency.

In this way, the numbers of the first cancel point, the second cancel point, the first system auxiliary filter 1116, and the second system auxiliary filter 1126 can be minimized within a range in which the noise can be satisfactorily canceled approximately regardless of the displacement of the head of the user. However, the predetermined distance L, which is the interval between the first cancel points or the interval between the second cancel points, may be an interval shorter than 1/10 of the wavelength of the upper limit frequency of the noise to be canceled.

Figure 4D:
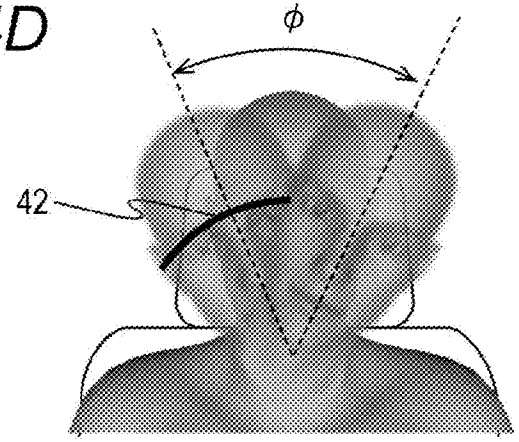

More specifically, the setting of the point set as described above may be performed as follows. That is, first, a trajectory 41 of the right ear when the head standing upright and facing front at a position, which is a position of the seat center in the left-right direction and within the existence range Y and the existence range Z in the front-back and up-down directions, is turned within the angular range θ is obtained as illustrated in FIG. 4C, and a trajectory 42 of the right ear when the head is bent sideways within the angular range φ is obtained as illustrated in FIG. 4D.

Figure 5A:
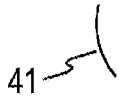
FIGS. 5A to 5C are diagrams illustrating a method of setting a point set according to the embodiment of the invention.
Figure 5B:
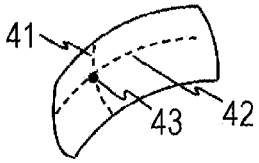
Figure 5C:
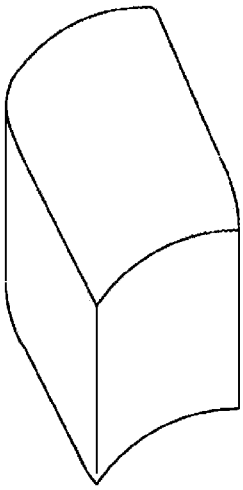

Then, a plane obtained as a trajectory obtained by moving the trajectory 41 illustrated in FIG. 5A along the trajectory 42 is obtained as illustrated in FIG. 5B, and the position of the right ear when the head on the obtained plane does not turn or flex laterally is set as a reference point 43. Then, the three-dimensional body obtained as a trajectory moved on the obtained plane is obtained as illustrated in FIG. 5C such that the reference point moves back and forth within the existence range Y and moves up and down within the existence range Z, and the obtained three-dimensional body is set as the first cancel point range.

Similarly, for the left ear, a three-dimensional body is obtained and set as the second cancel point range. Then, a plurality of first cancel points having an interval of the predetermined distance L is set so as to cover the entire first cancel point range. Here, each first cancel point set in this manner is the position of the right ear in each different head state within the head state range, and the corresponding head state can be calculated from the position of the first cancel point.

Therefore, for each first cancel point, a point within the second cancel point range corresponding to the same head state as the first cancel point is set as the second cancel point of the same point set as the first cancel point.

The transfer function H1_i($z$) set to the n first system auxiliary filters 1116 of the first system signal processing unit 111 and the transfer function H2_i($z$) set to the n second system auxiliary filters 1126 of the second system signal processing unit 112 are transfer functions learned and set in advance.

Hereinafter, learning of the transfer functions H1_i($z$) of the n first system auxiliary filters 1116 and the transfer functions H2_i($z$) of the n second system auxiliary filters 1126 will be described. First, learning of the transfer function H1_i($z$) of the first system auxiliary filter 1116 and the transfer function H2_i($z$) of the second system auxiliary filter 1126 is performed by executing the following first-stage learning process and second-stage learning process with the number of integers from 1 to n as i.

Figure 6:
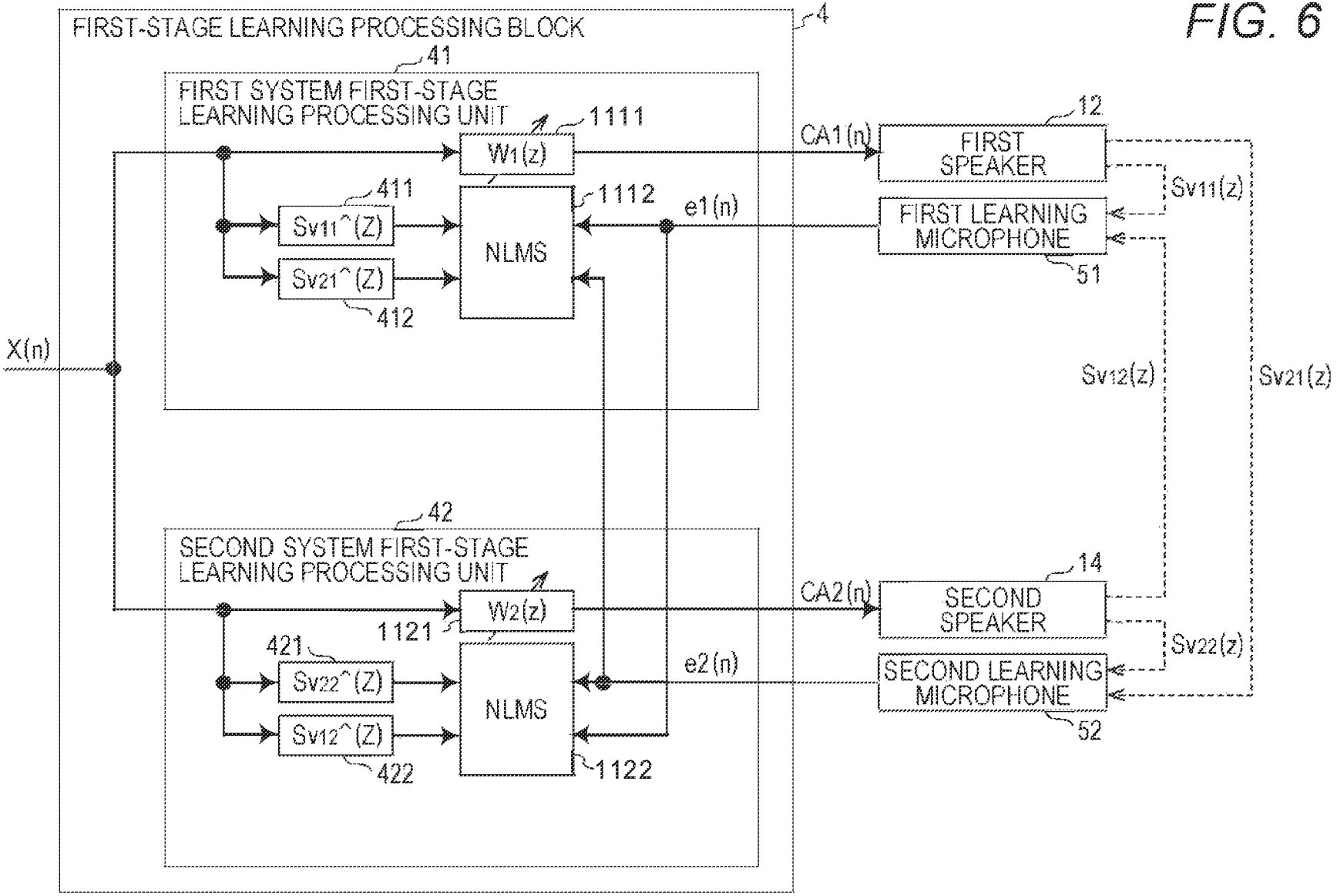
FIG. 6 is a block diagram illustrating a configuration of learning of a transfer function of an auxiliary filter according to the embodiment of the invention.

As illustrated in FIG. 6, the first-stage learning process is performed in a configuration in which the signal processing block 11 has been replaced with a first-stage learning processing block 4. Further, the first-stage learning process is performed by connecting a first learning microphone 51 disposed at the first cancel point of the i-th point set and a second learning microphone 52 disposed at the second cancel point of the i-th point set to the first learning processing block.

The first learning microphone 51 and the second learning microphone 52 are disposed, for example, by seating a dummy doll on a noise cancel target seat, adjusting the position and posture of the dummy doll such that the right ear is located at the first cancel point of the i-th point set and the left ear is located at the second cancel point of the i-th point set, installing the first learning microphone 51 at the position of the right ear of the dummy doll, installing the second learning microphone 52 at the position of the left ear of the dummy doll, and the like.

The first-stage learning processing block 4 includes a first system first-stage learning processing unit 41 and a second system first-stage learning processing unit 42. Then, the first system first-stage learning processing unit 41 removes the first system subtractor 1115, the first system auxiliary filter 1116, and the first system selector 1117 from the first system signal processing unit 111 of the signal processing block 11 illustrated in FIG. 3, provides a first system first-stage learning estimation filter 411 in which an estimated transfer function Sv11^($z$) of a transfer function Sv11($z$) from the first system first-stage learning processing unit 41 to the first learning microphone 51 is set instead of the first system first-stage estimation filter 1113, and provides a first system second-stage learning estimation filter 412 in which an estimated transfer function Sv21^($z$) of a transfer function Sv21($z$) from the first system first-stage learning processing unit 41 to the second learning microphone 52 is set instead of the first system second-stage estimation filter 1114, and, both the output of the first learning microphone 51 and the output of the second learning microphone 52 are input to the first system adaptive algorithm execution unit 1112 as errors.

In addition, the second system first-stage learning processing unit 42 removes the second system subtractor 1125, the second system auxiliary filter 1126, and the second system selector 1127 from the second system signal processing unit 112 of the signal processing block 11 illustrated in FIG. 3, provides a second system first-stage learning estimation filter 421 in which an estimated transfer function Sv22^($z$) of a transfer function Sv22($z$) from the second system first-stage learning processing unit 42 to the second learning microphone 52 is set instead of the second system first-stage estimation filter 1123, and provides a second system second-stage learning estimation filter 422 in which an estimated transfer function Sv12^($z$) of a transfer function Sv12($z$) from the second system first-stage learning processing unit 42 to the first learning microphone 51 is set instead of the second system second-stage estimation filter 1124, and both the output of the first learning microphone 51 and the output of the second learning microphone 52 are input to the second system adaptive algorithm execution unit 1122 as errors.

In such a configuration, the transfer function W1($z$) of the first system variable filter 1111 is converged and stabilized by the adaptive operation by the first system adaptive algorithm execution unit 1112, the transfer function W2($z$) of the second system variable filter 1121 is converged and stabilized by the adaptive operation by the second system adaptive algorithm execution unit 1122, and the converged and stabilized transfer functions W1($z$) and W2($z$) are obtained as a result of the first-stage learning process.

Figure 7:
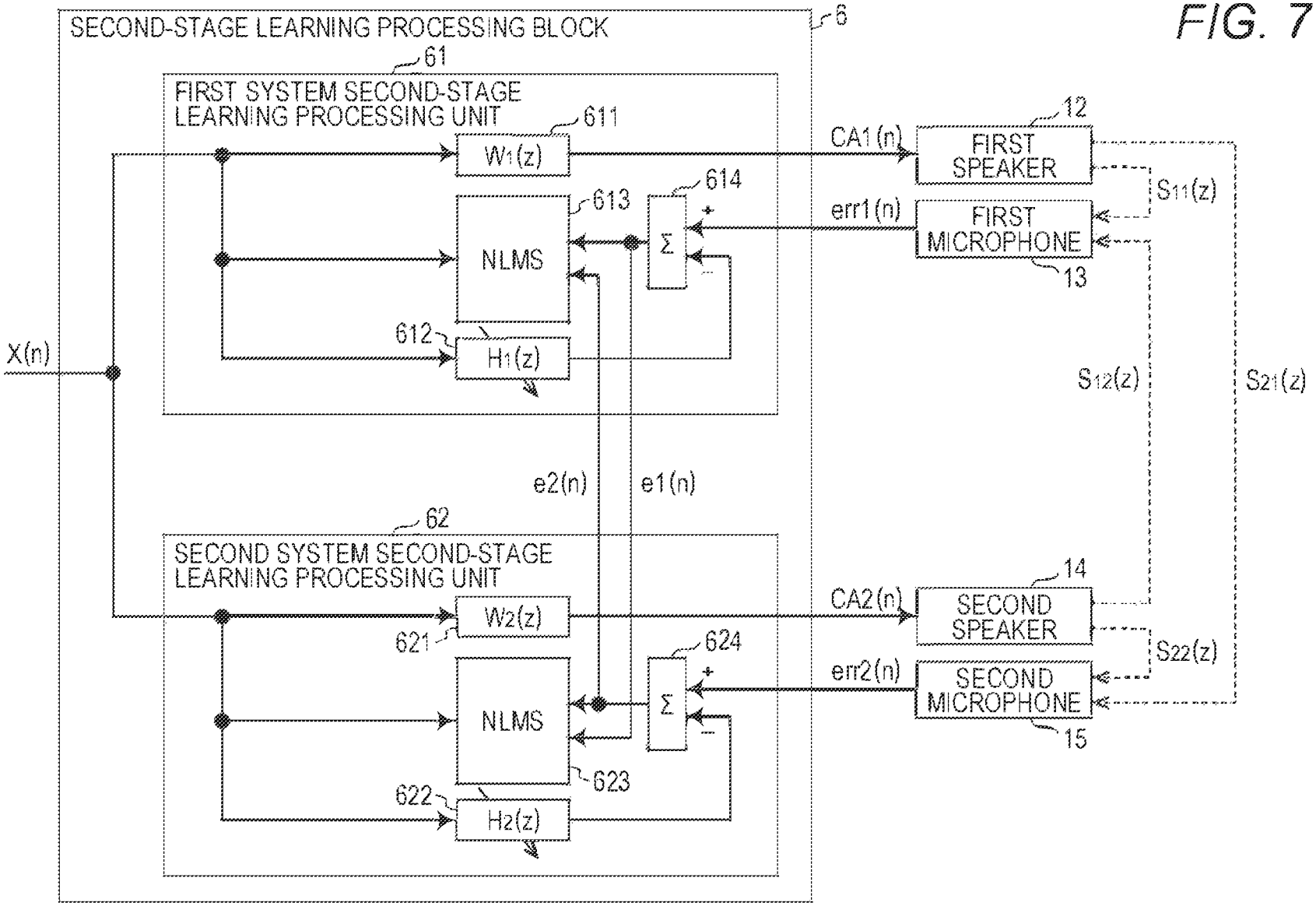
FIG. 7 is a block diagram illustrating a configuration of learning of a transfer function of an auxiliary filter according to the embodiment of the invention.

Next, in the second-stage learning process, as illustrated in FIG. 7, the signal processing block 11 is replaced with a second-stage learning processing block 6. The second-stage learning processing block 6 includes a first system second-stage learning processing unit 61 and a second system second-stage learning processing unit 62. Then, the first system second-stage learning processing unit 61 includes a first system fixed filter 611 for which the transfer function W1($z$) obtained as a result of the first-stage learning process is set as the transfer function, a first system second-stage learning variable filter 612, a first system second-stage learning adaptive algorithm execution unit 613, and a first system second-stage learning subtractor 614.

In addition, the second system second-stage learning processing unit 62 includes a second system fixed filter 621 for which the transfer function W2($z$) obtained as a result of the first-stage learning process is set as the transfer function, a second system second-stage learning variable filter 622, a second system second-stage learning adaptive algorithm execution unit 623, and a second system second-stage learning subtractor 624.

The noise signal x($n$) input to the first system second-stage learning processing unit 61 is output to the first speaker 12 through the first system fixed filter 611, and the noise signal x($n$) input to the second system second-stage learning processing unit 62 is output to the second speaker 14 through the second system fixed filter 621.

Further, the noise signal x($n$) input to the first system second-stage learning processing unit 61 is sent to the first system second-stage learning subtractor 614 through the first system second-stage learning variable filter 612, and the first system second-stage learning subtractor 614 subtracts the output of the first system second-stage learning variable filter 612 from the signal picked up by the first microphone 13 and outputs the subtracted signal as an error to the first system second-stage learning adaptive algorithm execution unit 613 and the second system second-stage learning adaptive algorithm execution unit 623 of the second system second-stage learning processing unit 62.

Furthermore, the noise signal x($n$) input to the second system second-stage learning processing unit 62 is sent to the second system second-stage learning subtractor 624 through the second system second-stage learning variable filter 622, and the second system second-stage learning subtractor 624 subtracts the output of the second system second-stage learning variable filter 622 from the signal picked up by the second microphone 15 and outputs the subtracted signal as an error to the second system second-stage learning adaptive algorithm execution unit 623 and the first system second-stage learning adaptive algorithm execution unit 613 of the first system second-stage learning processing unit 61.

Then, the first system second-stage learning adaptive algorithm execution unit 613 of the first system second-stage learning processing unit 61 updates the transfer function H1_i($z$) of the first system second-stage learning variable filter 612 so that the error input from the first system second-stage learning subtractor 614 and the second system second-stage learning subtractor 624 becomes 0, and the second system second-stage learning adaptive algorithm execution unit 623 of the second system second-stage learning processing unit 62 updates the transfer function H2_i($z$) of the second system second-stage learning variable filter 622 so that the error input from the first system second-stage learning subtractor 614 and the second system second-stage learning subtractor 624 becomes 0.

Then, in such a configuration, the transfer function H1($z$) of the first system second-stage learning variable filter 612 is converged and stabilized by the adaptive operation by the first system second-stage learning adaptive algorithm execution unit 613, the converged and stabilized transfer function H1($z$) is set as the transfer function H1_i($z$) of the i-th first system auxiliary filter 1116 of the first system signal processing unit 111 of the signal processing block 11, the transfer function H2($z$) of the second system second-stage learning variable filter 622 is converged and stabilized by the adaptive operation by the second system second-stage learning adaptive algorithm execution unit 623, and the converged and stabilized transfer function H2($z$) is set as the transfer function H2_i($z$) of the i-th second system auxiliary filter 1126 of the second system signal processing unit 112 of the signal processing block 11.

Next, control performed by the controller 16 during actual operation of the active noise control system 1 will be described. The controller 16 repeatedly performs processing of calculating the positions of the right ear and the left ear of the user from the position, posture, and the like of the head of the user seated on the noise cancel target seat detected by the DMS 17, identifying a point set in which the first cancel point and the second cancel point are most matching the position of the right ear and the position of the left ear of the user among the n point sets, controlling the first system selector 1117 of the first signal processing unit to select and output the output of the first system auxiliary filter 1116 corresponding to the identified point set, and controlling the second system selector 1127 of the second signal processing unit to select and output the output of the second system auxiliary filter 1126 corresponding to the identified point set. Note that the point set in which the first cancel point and the second cancel point are most matching the position of the user's right ear and the position of the user's left ear is obtained as, for example, a point set in which the maximum value of the distance between the first cancel point and the position of the user's right ear and the distance between the second cancel point and the position of the user's left ear is minimized.

An embodiment of the invention has been described above. In the embodiment, a case where there is only one noise source has been described. However, the above embodiment can also be applied to a case where there is a plurality of noise sources by extending the configuration of the signal processing block 11 so as to consider the propagation of noise from each noise source to each cancel point.

Further, in the above embodiment, the case where the microphone, the speaker, and the signal processing unit are provided for each of the right ear and the left ear has been described. However, the present embodiment can be similarly applied to a case where the microphone, the speaker, and the signal processing unit are provided for the head, and the noise audible in the right ear and the left ear is collectively canceled by the microphone, the speaker, and the signal processing unit common to the right ear and the left ear.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. An active noise control system for reducing noise, comprising:

a head detection unit configured to detect a position of a head of a user seated on a seat;

a switching control unit;

a speaker configured to output a noise cancel sound;

a microphone configured to detect an error signal;

a plurality of auxiliary filters, which correspond to a plurality of mutually different noise cancel positions, configured to generate and output, from a noise signal representing noise, a correction signal for correcting the error signal detected by the microphone so as to compensate for a difference between a position of the microphone and the noise cancel position corresponding to the auxiliary filter;

an error correction unit configured to correct the error signal output from the microphone with the correction signal output from one of the auxiliary filters and output the corrected signal as a corrected error signal; and an adaptive filter configured to perform an adaptation operation using the corrected error signal output from the error correction unit to generate the noise cancel sound output from the speaker from the noise signal, wherein the switching control unit causes the error correction unit to correct the error signal using the correction signal output from the auxiliary filter at which the corresponding noise cancel position matches the position of the head detected by the head detection unit, and the plurality of noise cancel positions to which the plurality of auxiliary filters correspond are a plurality of positions arranged at a predetermined interval in a space in which the user can move the head due to turning and side bending of the head, when the user sits on the seat, the head standing upright and facing front being at a position of a center of the seat in a left-right direction and at an arbitrary position within a predetermined range in up-down and front-back directions.

2. The active noise control system according to claim 1, wherein the predetermined interval is an interval of a distance of 1/10 of a wavelength of an upper limit frequency of noise to be canceled by the active noise control system.

3. The active noise control system according to claim 1, wherein the seat is a seat of an automobile.

4. An active noise control system for reducing noise, comprising:

a head detection unit configured to detect positions of left and right ears of a head of a user seated on a seat;

a switching control unit; and two noise control systems including a right ear noise control system and a left ear noise control system, wherein each noise control system includes:

a speaker configured to output a noise cancel sound;

a microphone configured to detect an error signal;

a plurality of auxiliary filters, which correspond to a plurality of mutually different noise cancel positions, configured to generate and output, from a noise signal representing noise, a correction signal for correcting the error signal detected by the microphone so as to compensate for a difference between a position of the microphone and the noise cancel position corresponding to the auxiliary filter;

an error correction unit configured to correct the error signal output from the microphone with the correction signal output from one of the auxiliary filters and output the corrected signal as a corrected error signal; and an adaptive filter configured to perform an adaptation operation using the corrected error signal output from the error correction unit of the right ear noise control system and the corrected error signal output from the error correction unit of the left ear noise control system to generate the noise cancel sound output from the speaker from the noise signal, wherein the switching control unit causes the error correction unit of the right ear noise control system to correct the error signal using the correction signal output from the auxiliary filter at which the corresponding noise cancel position matches the position of the right ear detected by the head detection unit, and causes the error correction unit of the left ear noise control system to correct the error signal using the correction signal output from the auxiliary filter at which the corresponding noise cancel position matches the position of the left ear detected by the head detection unit, the plurality of noise cancel positions to which the plurality of auxiliary filters of the right ear noise control system correspond are a plurality of positions arranged at a predetermined interval in a right ear target space that is a space in which the user can move the right ear due to turning and side bending of the head, when the user sits on the seat, the head standing upright and facing front being at a position of a center of the seat in a left-right direction and at an arbitrary position within a predetermined range in up-down and front-back directions, and the plurality of noise cancel positions to which the plurality of auxiliary filters of the left ear noise control system correspond are a plurality of positions arranged at a predetermined interval in a left ear target space that is a space in which the user can move the left ear due to turning and side bending of the head when the user sits on the seat, the head standing upright and facing front being at a position of a center of the seat in a left-right direction and at an arbitrary position within a predetermined range in up-down and front-back directions.

5. The active noise control system according to claim 4, wherein the right ear target space is a three-dimensional space obtained as a trajectory obtained by moving a plane obtained as a trajectory obtained by rotating a line, the line being obtained by rotating a point at a position of the right ear of the head at any position within the predetermined range in up-down and front-back directions at a position of a seat center in a left-right direction, around a turning axis of the head at the position within a predetermined angular range within a laterally bendable angle range around a side bending axis of the head at the position within a predetermined angular range within a side bendable angular range within a range in which the right ear moves in the up-down and front-back directions with movement of the head standing upright and facing front within the predetermined range, and the left ear target space is a three-dimensional space obtained as a trajectory obtained by moving a plane obtained as a trajectory obtained by rotating a line, the line being obtained by rotating a point at a position of the left ear of the head at any position within the predetermined range in up-down and front-back directions at a position of a seat center in a left-right direction, around a turning axis of the head at the position within a predetermined angular range within a laterally bendable angle range around a side bending axis of the head at the position within a predetermined angular range within a side bendable angular range within a range in which the left ear moves in the up-down and front-back directions with movement of the head standing upright and facing front within the predetermined range.

6. The active noise control system according to claim 5, wherein the seat is a seat of an automobile.

7. The active noise control system according to claim 4, wherein the predetermined interval is an interval of a distance of 1/10 of a wavelength of an upper limit frequency of noise to be canceled by the active noise control system.

8. The active noise control system according to claim 4, wherein the seat is a seat of an automobile.

9. An active noise control system for reducing noise, comprising:

a head detection unit configured to detect a position of a head of a user;

a switching control unit;

a speaker configured to output a noise cancel sound;

a microphone configured to detect an error signal;

a plurality of auxiliary filters, which correspond to a plurality of mutually different noise cancel positions, configured to generate and output, from a noise signal representing noise, a correction signal for correcting the error signal detected by the microphone;

an error correction unit configured to correct the error signal output from the microphone with the correction signal output from one of the auxiliary filters and output the corrected signal as a corrected error signal; and an adaptive filter configured to perform an adaptation operation using the corrected error signal output from the error correction unit to generate the noise cancel sound output from the speaker from the noise signal, wherein the switching control unit causes the error correction unit to correct the error signal using the correction signal output from the auxiliary filter at which the corresponding noise cancel position matches the position of the head detected by the head detection unit, and the plurality of noise cancel positions to which the plurality of auxiliary filters correspond are a plurality of positions arranged at a predetermined interval in a space in which the user can move the head within a predetermined range.

10. The active noise control system according to claim 9, wherein the head detection unit is configured to detect positions of left and right ears of the user, and the active noise control system includes two noise control systems including a right ear noise control system and a left ear noise control system.

11. The active noise control system according to claim 9, wherein the predetermined interval is an interval of a distance of 1/10 of a wavelength of an upper limit frequency of noise to be canceled by the active noise control system.

12. The active noise control system according to claim 9, wherein the head detection unit is configured to detect the position of the head of the user seated on a seat of an automobile.

* * * * *